US007363922B2

(12) United States Patent
Lang et al.

(10) Patent No.: US 7,363,922 B2
(45) Date of Patent: Apr. 29, 2008

(54) FLAT CHISEL

(75) Inventors: Marco Lang, Ravensburg (DE); Stefano Monzani, Brembate (IT); Franc Koljaka, Bergamo (IT)

(73) Assignees: Hawera Probst GmbH, Ravensburg (DE); Aresi S.p.A., Brembate Sotto Bergamo (IT)

( * ) Notice: Subject to any disclaimer, the term of this patent is extended or adjusted under 35 U.S.C. 154(b) by 473 days.

(21) Appl. No.: 10/381,340

(22) PCT Filed: Jul. 3, 2002

(86) PCT No.: PCT/EP02/07336

§ 371 (c)(1),
(2), (4) Date: Mar. 25, 2003

(87) PCT Pub. No.: WO03/008155

PCT Pub. Date: Jan. 30, 2003

(65) Prior Publication Data

US 2004/0010921 A1 Jan. 22, 2004

(30) Foreign Application Priority Data

Jul. 17, 2001 (DE) ..... 101 33 946

(51) Int. Cl.
*B28D 1/26* (2006.01)

(52) U.S. Cl. ..... 125/41; 125/36

(58) Field of Classification Search ..... 125/40, 125/41, 42, 43; 30/167, 168; 81/463
See application file for complete search history.

(56) References Cited

U.S. PATENT DOCUMENTS

| | | | | |
|---|---|---|---|---|
| 1,350,241 | A * | 8/1920 | Routh | 30/168 |
| 1,452,037 | A * | 4/1923 | Gleasner | 299/69 |
| 1,742,726 | A * | 1/1930 | Pfister | 118/35 |
| 2,735,179 | A * | 2/1956 | Stanton | 30/168 |
| 4,089,562 | A * | 5/1978 | Baumeister | 299/100 |

FOREIGN PATENT DOCUMENTS

| | | |
|---|---|---|
| DE | 81 17 222 | 12/1982 |
| DE | 83 20 045 | 11/1983 |
| DE | 197 57 271 | 6/1999 |
| EP | 0 497 307 | * 1/1992 |
| EP | 0 925 881 | * 10/1998 |
| FR | 2 431 351 | 2/1980 |
| GB | 606543 | 8/1948 |
| GB | 634743 | 3/1950 |
| GB | 934309 | 8/1963 |
| JP | 05-318987 | 12/1993 |

* cited by examiner

*Primary Examiner*—Dung Van Nguyen
(74) *Attorney, Agent, or Firm*—Venable LLP; Robert Kinberg; Lars H. Genieser

(57) ABSTRACT

The invention relates to a flat chisel, in particular an insertion chisel for power-driven drill and chisel hammers for working stone, having a chisel head which has a main tip disposed transversely to a chisel longitudinal axis, a front and rear striking surface, and at least one side face connecting the striking faces. In this case, a side face designed as a side lip is provided.

2 Claims, 2 Drawing Sheets

FLAT CHISEL

BACKGROUND OF THE INVENTION

The invention relates to a flat chisel, in particular an insertion chisel.

Such flat chisels are used when working stone, in particular masonry, in order to produce, for example, apertures, channels and slots. Flat chisels whose main lip is arranged transversely to a chisel longitudinal axis are known from the prior art. A disadvantage with such chisels is that, in particular when working material during which the chisel, with the chisel head, penetrates deeper into the stone, they tend to jam in the material. The jamming in the material takes place in particular at the side faces of the chisel head, which are oriented perpendicularly to the lip of the chisel.

BRIEF SUMMARY OF THE INVENTION

The object of the invention is to develop a flat chisel which has a low tendency to jam in the stone to be worked.

The object is achieved according to the present invention. In particular, the flat chisel is an insertion chisel for power-driven drill and chisel hammers having a chisel head having a main lip disposed transversely to a chisel longitudinal axis, a front and a rear striking face, and at least one side face connecting the striking faces. The side face is designed as a side lip. Advantageous and expedient developments are specified herein.

The flat chisel according to the invention has at least one side face designed as a side lip. Due to the side face designed as a side lip, the chisel is able to work the material located in the region of the side face. By this working, jamming of the chisel head in the stone in the region of the side face is prevented, since the side face designed as a side lip shapes the material to be worked. Therefore material which impedes the chisel head in the region of the side face is already disintegrated when the chisel penetrates and is cleared out of the way.

The term "flat chisel" is intended to refer to a chisel having an elongated cutting edge which runs essentially perpendicularly to a chisel longitudinal axis or transversely to a striking direction.

According to an advantageous design of the subject matter of the invention, at least one side lip merges into the main lip. This avoids a lip-free region, at which jamming of the chisel with the material to be worked may occur. In addition, the lips stabilize one another.

An advantageous design of the subject matter of the invention provides for the cutting edges of the main lip and of the side lip to be arranged in a common plane. As a result, transverse loading of the lips or cutting edges during the penetration or withdrawal of the flat chisel from the material is largely avoided.

Due to an embodiment of the main lip and/or side lip which is gabel-shaped in cross section, the flat chisel is suitable for the most varied applications and setting angles. By means of a ramp-shaped design of the main lip and/or side lip, it is possible to realize particularly pointed lips which promote perpendicular penetration into the material to be worked. Furthermore, lips of such a design enable the chisel to be applied to the material to be worked at an especially small angle.

BRIEF DESCRIPTION OF THE DRAWINGS

Further details of the invention are described in the drawing with reference to schematically shown exemplary embodiments. The figures are partly CAD illustrations in which the chisels are shown by grid lines. In this case, hidden edges are also shown as solid lines.

In the drawing.

DETAILED DESCRIPTION OF THE INVENTION

Figure 1:
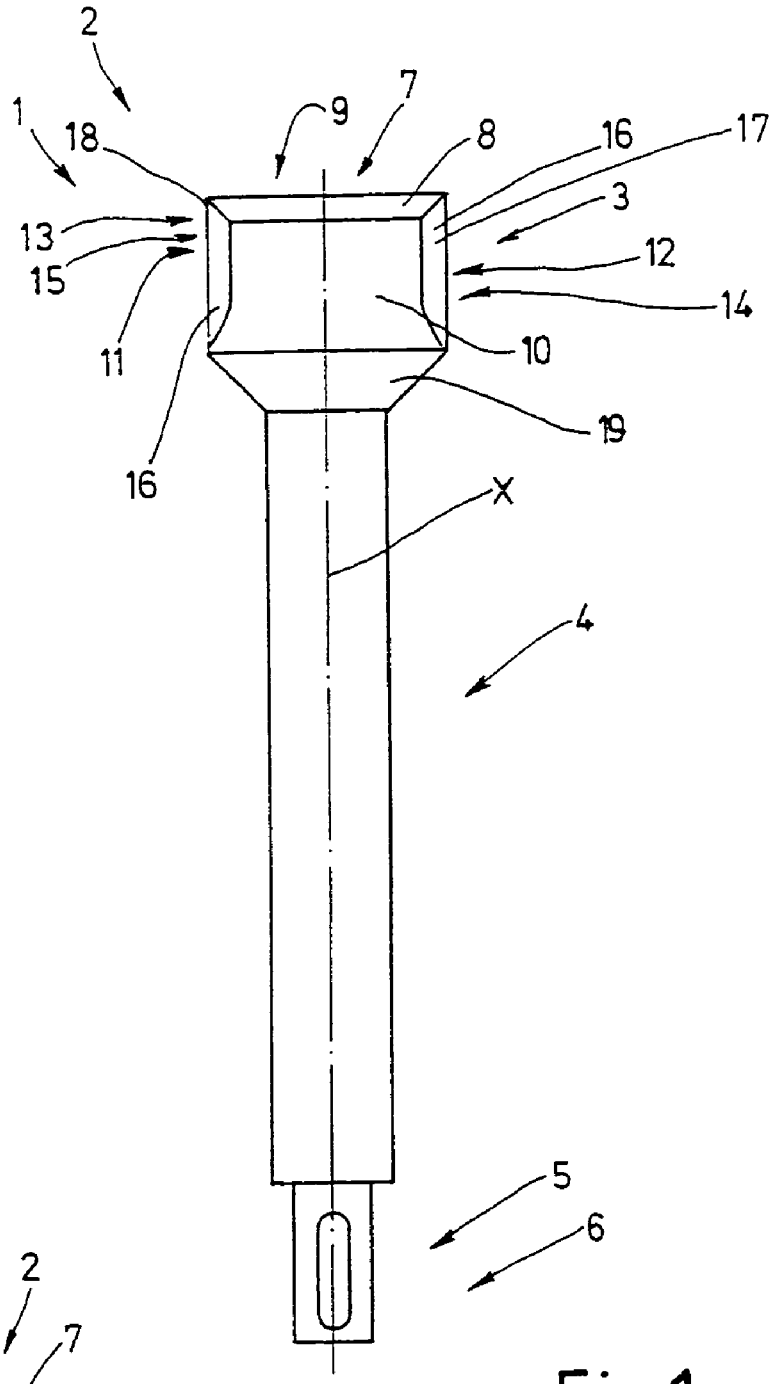
FIG. 1 shows a side view of a chisel.

Shown in FIG. 1 is a chisel 1 which is designed as a flat chisel 2 and essentially comprises a chisel head 3, a chisel shank 4 and a clamping shank 5 or insertion end. The clamping shank 5 is an "SDS-plus clamping shank" 6 which serves for coupling to power-driven rotary hammers. Such chisels are also referred to as insertion chisels. Arranged on the chisel head 3 perpendicularly to a chisel longitudinal axis x is a main lip 7, which merges via a front cutting face 8 and a rear cutting face 9 into a front striking face 10 and a rear striking face 11. Side faces 12, 13 of the chisel head 3 are designed as side lips 14, 15 which merge into the striking faces 10, 11 via cutting faces 16. Cutting edges 17, 18 of the side lips 14, 15 run approximately parallel to the center longitudinal axis x of the flat chisel 2. The chisel head 3 merges into the chisel shank 4 in a transition region 19.

Figure 2:
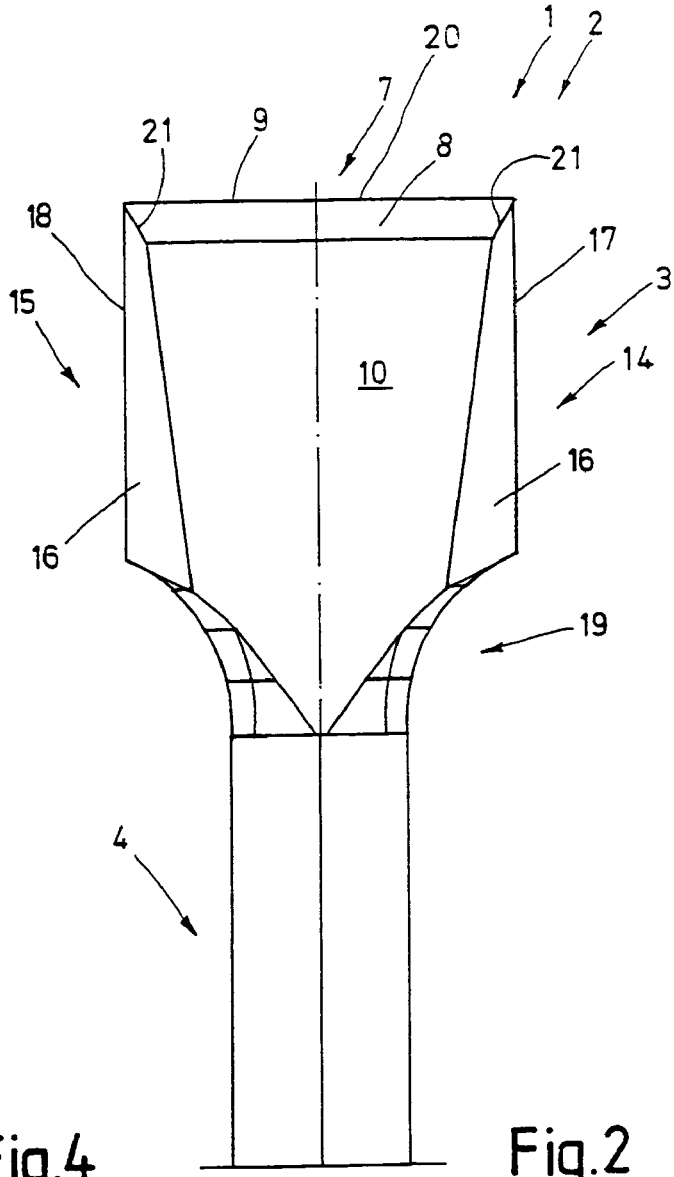
FIG. 2 shows a partial view of a second chisel.

FIG. 2 shows a partial view of a second chisel 1 or second flat chisel 2, of which only a chisel head 3 and part of the chisel shank 4 is shown. Two side lips 14, 15, which have side faces 16, are assigned to a main lip 7 having cutting faces 8, 9 and a cutting edge 20. The cutting faces 16 widen in the direction of a clamping shank (not shown). Cutting edges 17, 18 of the side lips 14, 15 run approximately at a right angle to the cutting edge 20 of the main lip 7. A front striking face 10, into which the cutting faces 8 and 16 merge, runs in a transition region 19 up to the chisel shank 4. The main lip 7 merges into the side lips 14, 15 at separating edges 21.

Figure 3:
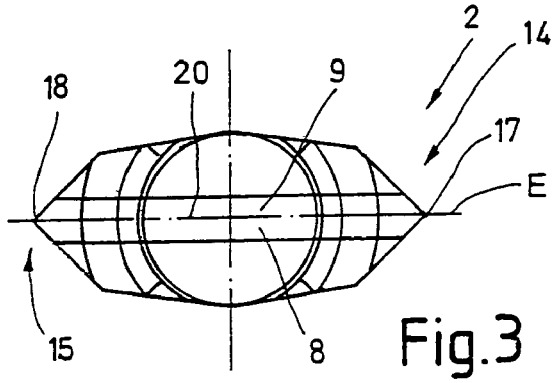
FIG. 3 shows a plan view of the chisel shown in FIG. 2.

FIG. 3 shows a plan view of the flat chisel 2 shown in FIG. 2. The cutting faces 8, 9, which converge in the main lip 20, can be seen here. The main lip 20 and the side lips 14, 15 run in a common plane E which is perpendicular to the drawing plane.

Figure 4:
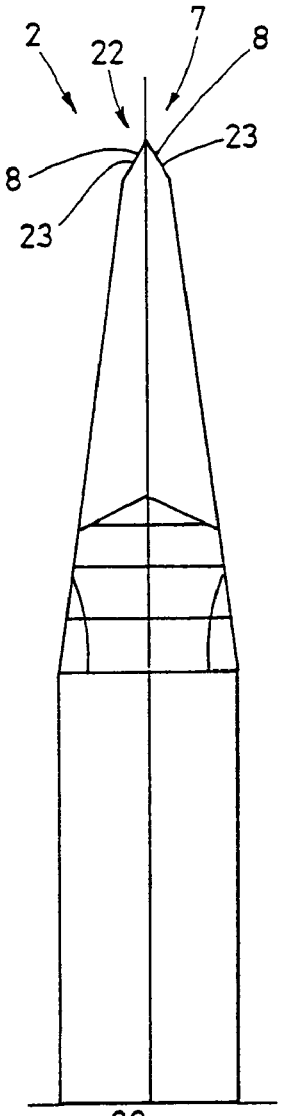
FIG. 4 shows a side view from the right of the chisel shown in FIG. 2.

FIG. 4 shows a side view from the right of the flat chisel 2 shown in FIG. 2. As viewed from the side or in cross section, the main lip 7 forms a gable 22, the gable faces 23 of which are formed by the cutting faces 8, 9.

Figure 5:
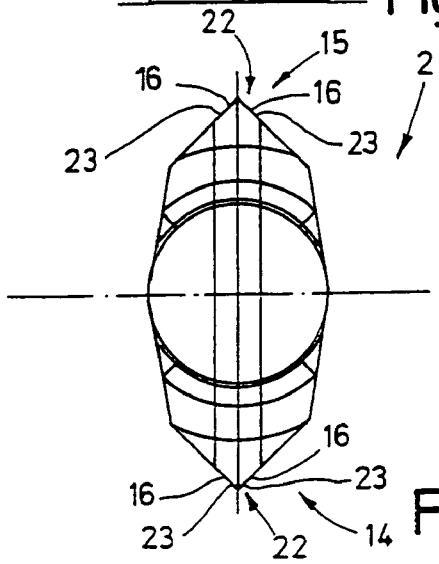
FIG. 5 shows a plan view of the chisel shown in FIG. 4.

FIG. 5 shows a plan view of the flat chisel 2 shown in FIG. 4. As viewed in cross section or from the side, the side lips 14, 15, with their cutting faces 16, also form gables 22, the cutting faces 16 likewise forming gable faces 23.

Figure 6:
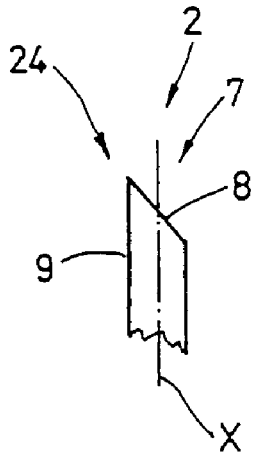
FIG. 6 shows a side view of a ramp-shaped lip.

FIG. 6 shows a main lip 7 of a flat chisel 2 not shown in any more detail. The main lip 7, as viewed in cross section or from the side, is designed as a ramp 24 and has a cutting face 9 [sic] running parallel to a chisel longitudinal axis x and a cutting face 8 [sic] running at an angle thereto.

The invention is not restricted to exemplary embodiments shown and described. On the contrary, it comprises developments of the invention within the scope of the patent claims. In particular, provision is also made for the cutting edges of the side lips to be arranged at an angle to the cutting edge of the main lip differing from 90°.

LIST OF DESIGNATIONS

1 Chisel
2 Flat chisel
3 Chisel head
4 Chisel shank
5 Clamping shank
6 SDS-plus clamping shank
7 Main lip
8 Front cutting face
9 Rear cutting face
10 Front striking face
11 Rear striking face
12 Right-hand side face
13 Left-hand side face
14 Right-hand side lip
15 Left-hand side lip
16 Cutting face of 14, 15
17 Cutting edge
18 Cutting edge
19 Transition region
20 Cutting edge
21 Separating edge
22 Gable
23 Gable face
24 Ramp

The invention claimed is:

1. An insertion chisel for power-driven hammers for working stone comprising:

a chisel head having a main lip disposed transversely to a chisel longitudinal axis, a front and a rear striking face, and at least one side face connecting the striking faces; and a shank attached to the chisel head having a means for attaching the insertion chisel to a power-driven hammer;

wherein the side face includes a side lip and the side lip prevents the tendency of the insertion chisel to jam in the stone while the power-driven hammer causes the insertion chisel to work the stone; and wherein the main lip and the side lip have cutting edges which lie in a common plane.

2. An insertion chisel for power-driven hammers for working stone comprising:

a chisel head having a main lip disposed transversely to a chisel longitudinal axis, a front and a rear striking face, and at least one side face connecting the striking faces; and a shank attached to the chisel head having a means for attaching the insertion chisel to a power-driven hammer;

wherein the side face includes a side lip and the side lip prevents the tendency of the insertion chisel to jam in the stone while the power-driven hammer causes the insertion chisel to work the stone; and wherein the side lip is gable-shaped in cross section.

* * * * *